US011370465B2

(12) United States Patent
Zhang et al.

(10) Patent No.: US 11,370,465 B2
(45) Date of Patent: Jun. 28, 2022

(54) METHODS AND SYSTEMS FOR DYNAMIC WEIGHT MANAGEMENT

(71) Applicant: Transportation IP Holdings, LLP, Norwalk, CT (US)

(72) Inventors: Jingjun Zhang, Erie, PA (US); Bret D. Worden, Erie, PA (US); Ibrahim Kacar, Erie, PA (US); John Frederick, Erie, PA (US)

(73) Assignee: Transportation IP Holdings, LLP, Norwalk, CT (US)

( * ) Notice: Subject to any disclaimer, the term of this patent is extended or adjusted under 35 U.S.C. 154(b) by 429 days.

(21) Appl. No.: 16/438,820

(22) Filed: Jun. 12, 2019

(65) Prior Publication Data

US 2020/0391773 A1 Dec. 17, 2020

(51) Int. Cl.
*B61F 5/38* (2006.01)
*B61L 3/00* (2006.01)

(52) U.S. Cl.
CPC ..... *B61F 5/383* (2013.01); *B61F 5/386* (2013.01); *B61L 3/006* (2013.01)

(58) Field of Classification Search
None
See application file for complete search history.

(56) References Cited

U.S. PATENT DOCUMENTS

| | | | | |
|---|---|---|---|---|
| 8,196,519 | B2 * | 6/2012 | Kumar | B61C 15/04 105/75 |
| 8,468,952 | B2 | 6/2013 | Worden et al. | |
| 2009/0031915 | A1 | 2/2009 | Kumar et al. | |
| 2009/0031916 | A1 | 2/2009 | Kumar et al. | |
| 2011/0082606 | A1 | 4/2011 | Kumar et al. | |
| 2012/0253565 | A1 | 10/2012 | Kumar et al. | |

FOREIGN PATENT DOCUMENTS

WO WO-2011043966 A2 * 4/2011 ..... B61F 3/06

* cited by examiner

*Primary Examiner* — Sze-Hon Kong
*Assistant Examiner* — Ana D Thomas
(74) *Attorney, Agent, or Firm* — McCoy Russell LLP

(57) ABSTRACT

A method for reducing slack in a linkage chain of a vehicle truck assembly is provided. In one example, the method includes responding to a request to de-lift a lift mechanism by reducing pressure in an actuator coupled to the lift mechanism, where the lift mechanism is configured to transfer a load from a first axle to a second axle of the vehicle during the de-lift, and during the de-lift, maintaining the pressure in the actuator at or above a threshold pressure to maintain tension in a weight transfer device of the lift mechanism.

18 Claims, 7 Drawing Sheets

METHODS AND SYSTEMS FOR DYNAMIC WEIGHT MANAGEMENT

BACKGROUND

Technical Field

The subject matter disclosed herein relates to an actuation system coupled to a truck assembly in a vehicle.

Discussion of Art

Vehicles may be configured with truck assemblies including two trucks per assembly and multiple axles per truck. Trucks with multiple axles may include at least one powered axle and at least one non-powered axle. The axles may be mounted to the truck via lift mechanisms (e.g., pneumatic actuators)) for adjusting a distribution of vehicle weight (including a vehicle body weight and a vehicle truck weight) between the axles. Weight distribution among the powered and non-powered axles may be performed statically and/or dynamically by adjusting a mechanism that provides dynamic weight management (DWM). Reference to the term dynamic herein may be defined as a process or system characterized by constant change, activity, or progress. Hence, dynamic weight management indicates weight management that continuously responds to changes in vehicle operation and conditions.

The DWM mechanism may include an actuatable linkage arrangement with a lever coupled to a carrier by a lifting chain, the carrier supporting a non-powered axle. The linkage between the lever and carrier, as provided by the lifting chain, may enable dynamic re-distribution of a load to other axles, e.g., the at least one powered axle, by implementing lift via a lift mechanism. A weight on the non-powered axle is thereby reduced in response to vehicle operating conditions, increasing the weight on powered axles and a tractive force from the vehicle on a receiving structure, such as a rail. The lift mechanism may also decrease lift, transferring a portion of the load to the non-powered axle in response to an event such as vehicle braking.

Over time, components of the DWM mechanism may degrade. For example, the lifting chain may come into contact with the truck frame and abrade the truck frame surface. Variations in chain tension between fully taut and slack may lead to links of the lifting chain compressing and moving forcibly against one another, resulting in weakening and/or bending of the links. As a result, maintenance and replacement of DWM components may occur more frequently. It may be desirable to have a system and method that differs from those that are currently available.

BRIEF DESCRIPTION

In an embodiment, a method for a vehicle (e.g., a vehicle having a truck or bogie with two or more axles) includes responding to a request to de-lift a lift mechanism by reducing pressure in an actuator coupled to the lift mechanism, the lift mechanism configured to transfer a load from a first axle to a second axle of the vehicle during the de-lift, and during the de-lift, maintaining the pressure in the actuator at or above a threshold pressure to maintain tension in a weight transfer device of the lift mechanism.

In another embodiment, a method may include adjusting a lift mechanism configured to dynamically transfer a load between a first axle and a second axle via a linkage arrangement coupled to the lift mechanism. By transferring the load between the first axle and the second axle, slack in a linking component of the linkage arrangement may be reduced. In addition, the method may also include detecting an air leak in a pneumatic actuator of the lift mechanism, where the actuator is coupled to the linkage arrangement and configured to adjust a both position of the linkage arrangement as well as tension on the linkage component.

In yet another embodiment a system for a vehicle includes a truck with a plurality of axles including a non-powered axle and a powered axle. The system also has lift mechanism coupled to the truck by a linkage arrangement and the lift mechanism may have a chain extending between a chain crank coupled to a frame of the truck and a carrier of the lift mechanism. An actuating system may adjust the lift mechanism by rotating the chain crank. The system further includes a control system with a computer readable storage medium storing instructions executable to respond to a request for weight transfer from the non-powered axle to the powered axle. In response to the request, the actuation system may be adjusted to maintain tension on the chain by maintaining a threshold level of pressure in the actuation system. In this way, degradation to components of the vehicle truck assembly may be reduced, thereby increasing component life and reducing maintenance and repair events.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Figure 3:
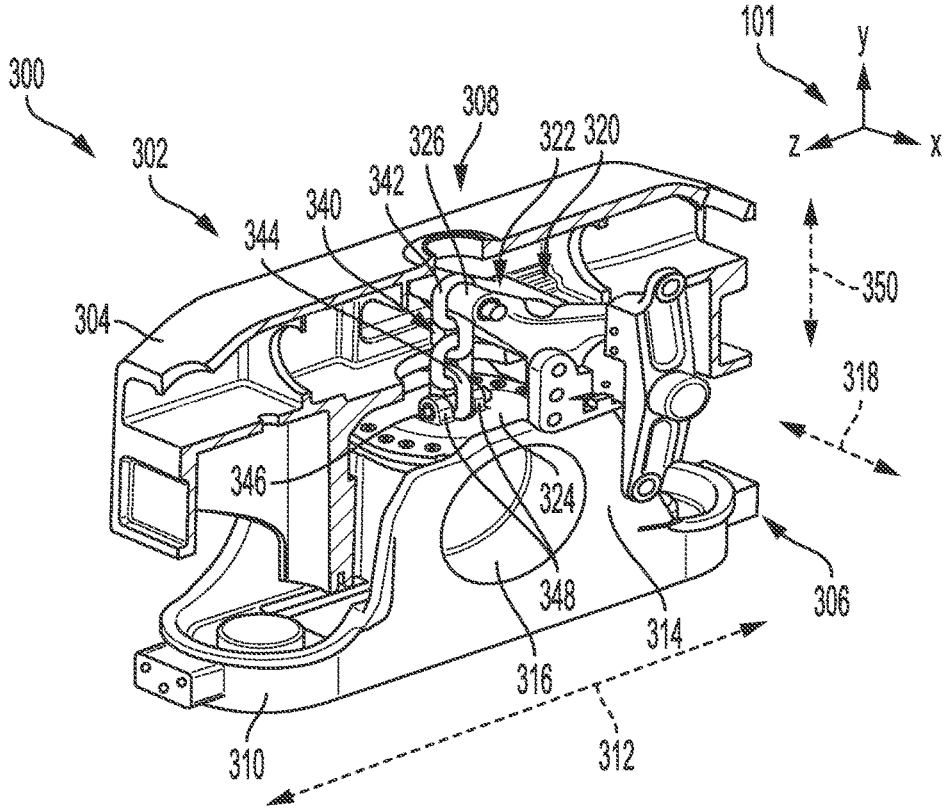
FIG. 3 shows a perspective view of a section of the truck including an example linkage arrangement that may be coupled to a lift mechanism.
Figure 4:
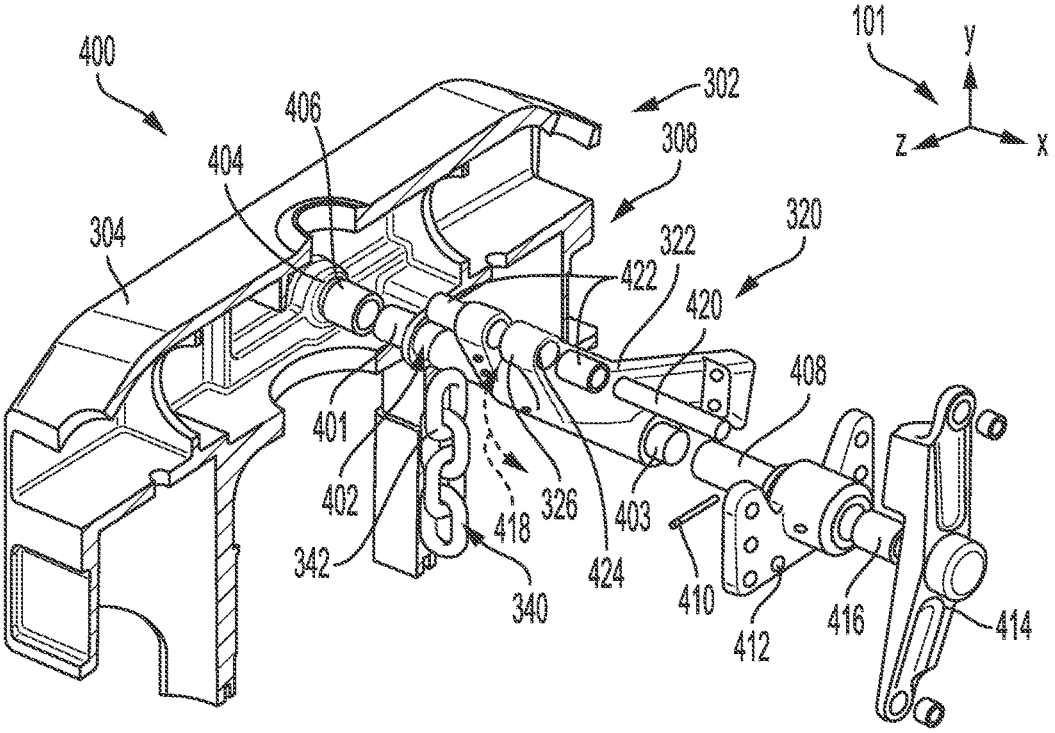
FIG. 4 shows an exploded view of the linkage arrangement of FIG. 3.
Figure 5:
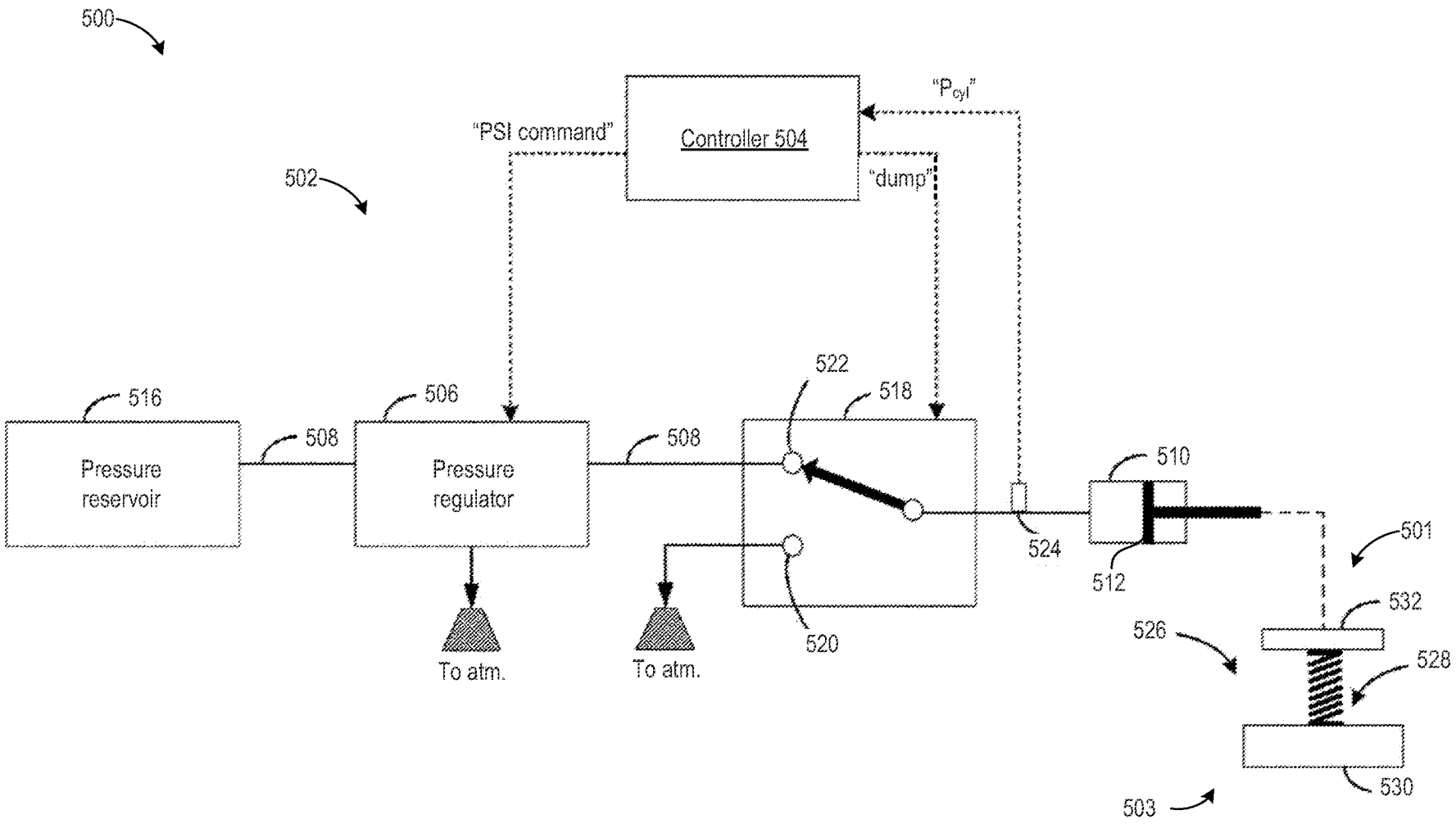
FIG. 5 shows an example schematic diagram of a pneumatic actuation system of a lift mechanism.
Figure 6:
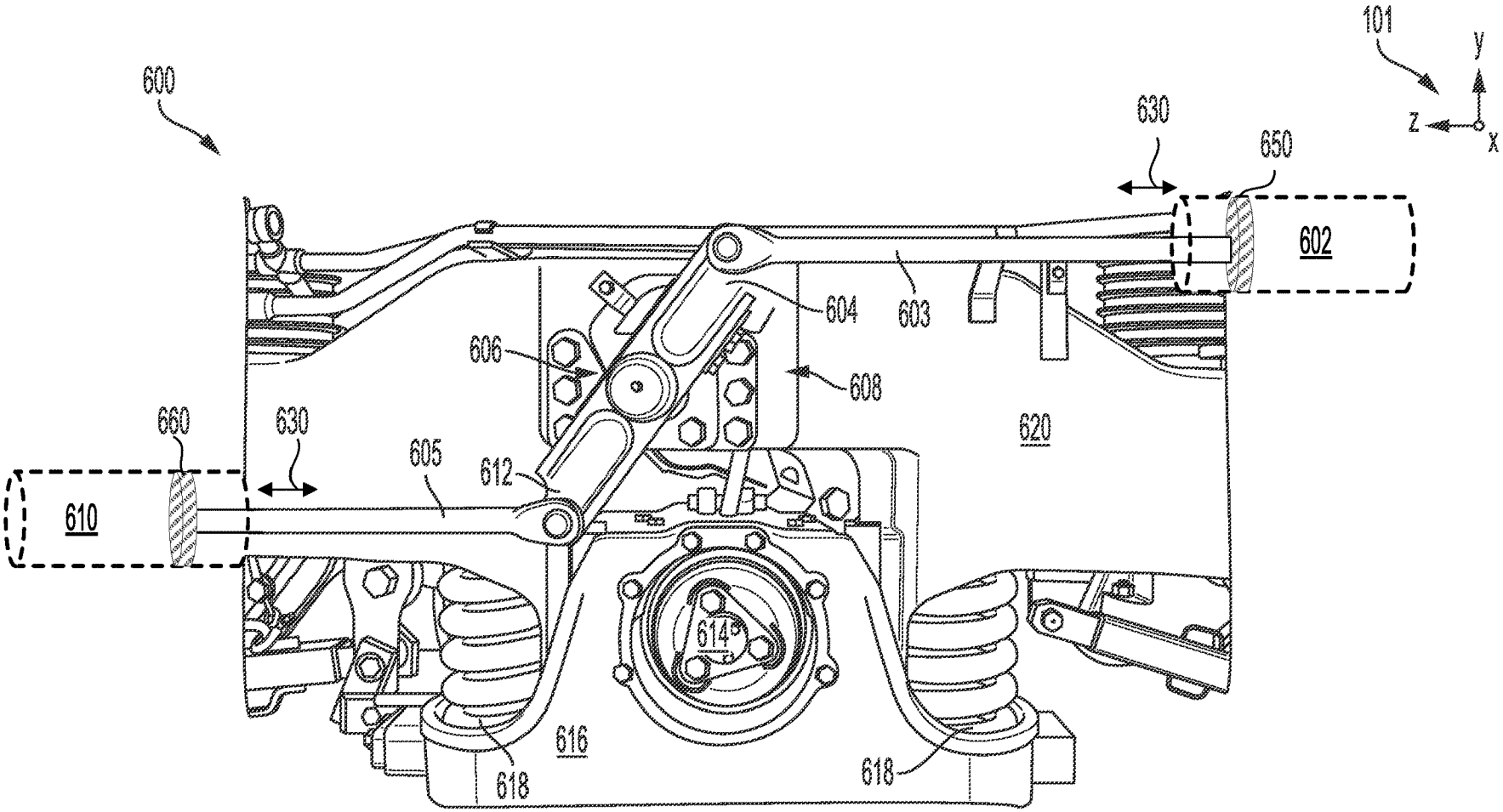
FIG. 6 shows an example of a linkage arrangement coupled to a lift mechanism and a pneumatic actuation system of a lift mechanism.
Figure 7:
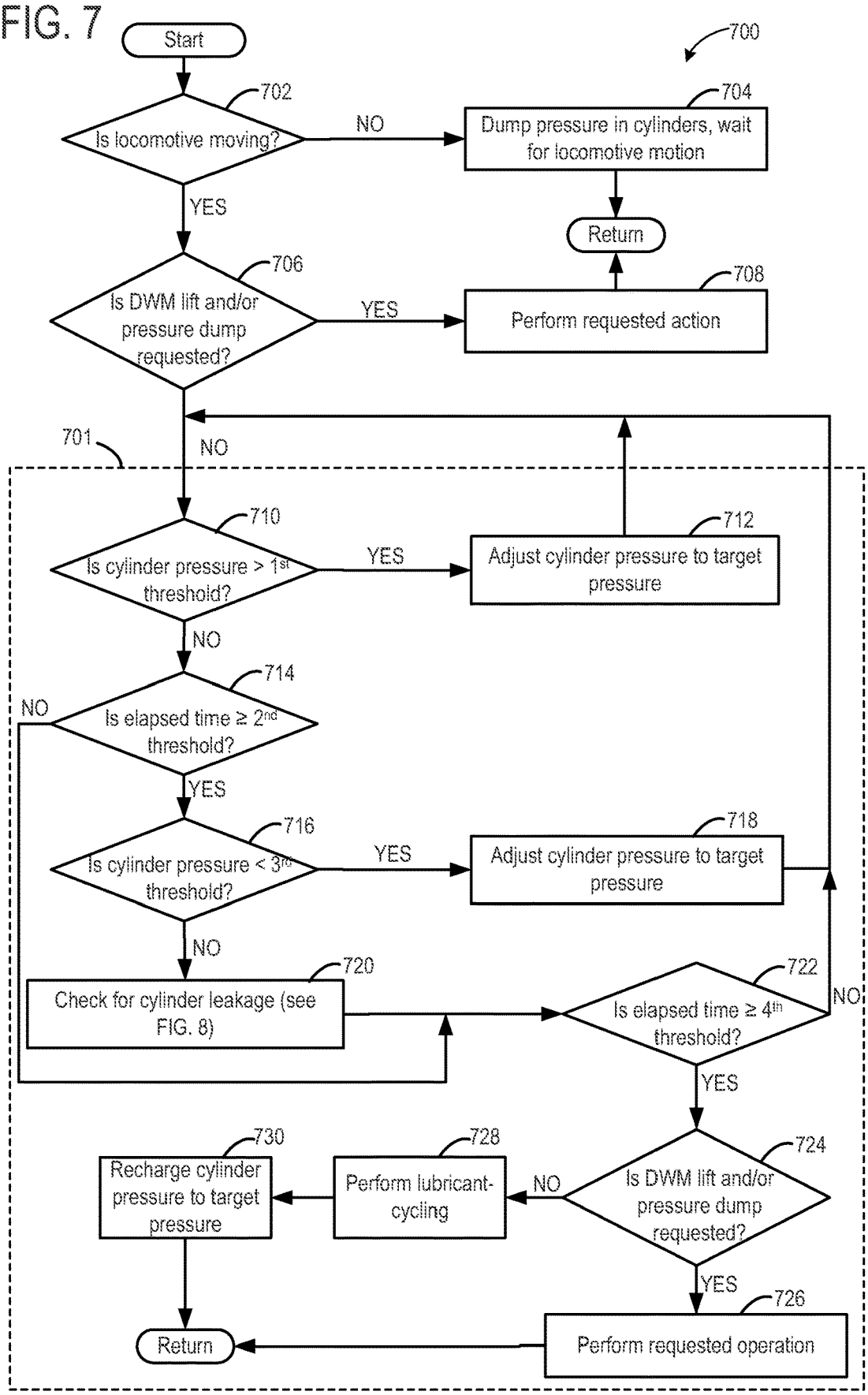
FIG. 7 shows an example of a method for adjusting lift provided by a lift mechanism and reducing slack in a linkage chain of a linkage arrangement coupled to the lift mechanism.
Figure 8:
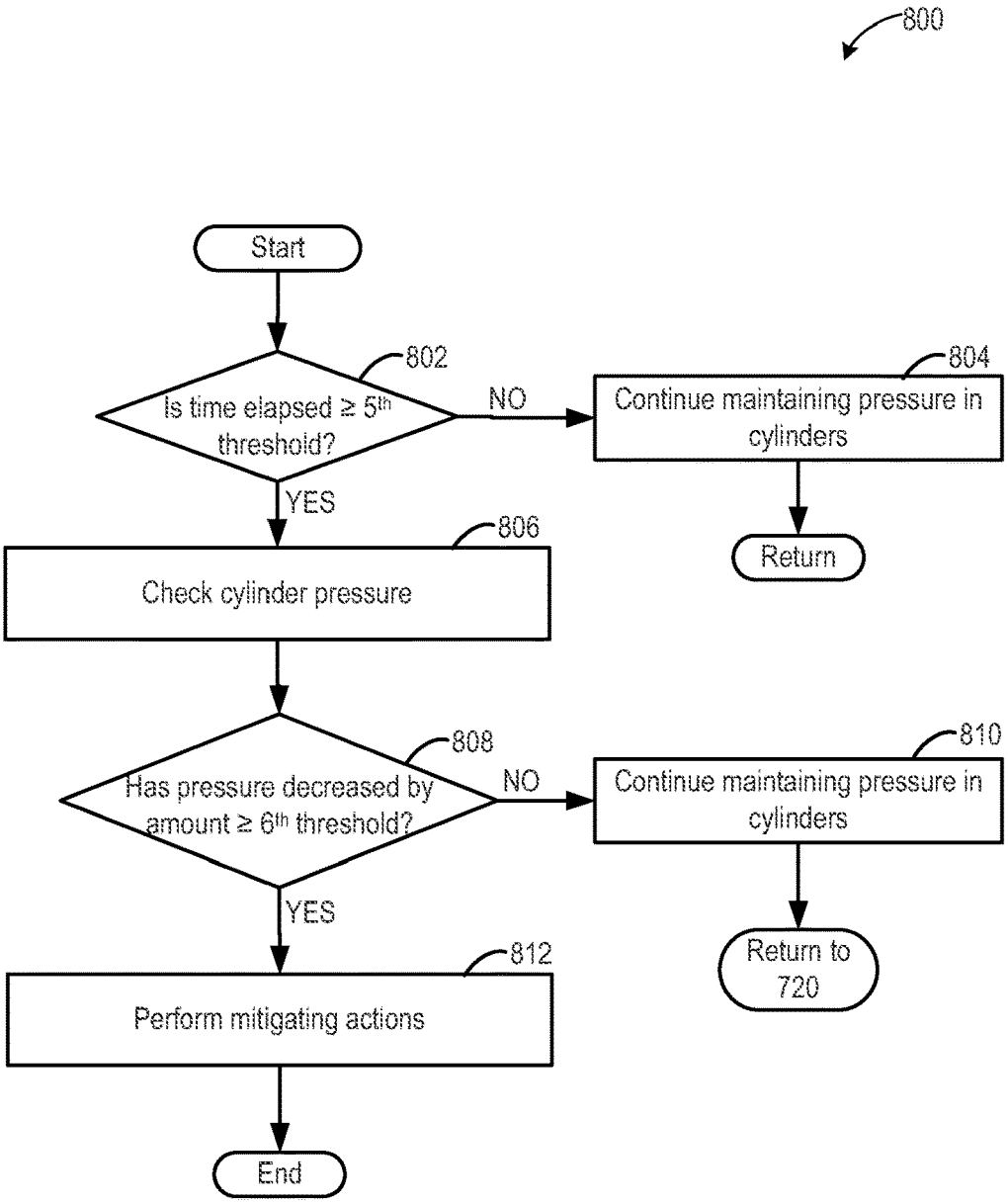
FIG. 8 shows an example of a method that continues from FIG. 7 for detecting air leaks in one or more actuators of the lift mechanism.

According to aspects of the invention, vehicles may have a chassis or truck assembly that includes lift mechanisms (e.g., suspension systems) for transferring weight among wheels and/or axles supporting the vehicle. An example of a lift mechanism enabling dynamic weight management (DWM) is shown in a schematic diagram of a rail vehicle in FIG. 1, as well as in a sectional view of a truck with the lift mechanism in FIG. 2. During DWM, a weight of the rail vehicle may be selectively and dynamically redistributed among powered and non-powered axles to accommodate vehicle operating conditions. A DWM system may include the truck, the lift mechanism, a carrier, a non-powered axle, and a linkage arrangement that links the carrier to the truck and communicates changes in load (e.g. locomotive weight) to the lift mechanism and therefore to the non-powered axle. A section of the truck that includes the lift mechanism coupled to the non-powered axle is illustrated in FIG. 3, depicting the linkage arrangement coupled to the lift mechanism and includes a linking component such as a chain linking a lever arm to the carrier of the lift mechanism. In some examples, the chain may alternate between a higher degree of tension when lifting of the lift mechanism is compelled, and slack due to a reduction in lift. When the chain is slack, and the vehicle is operating, motion, e.g., swinging, bouncing, etc., of the chain may lead to high impact collisions between the chain and other components of the DWM system, such as the truck frame or a shaft retaining pin, as shown in an exploded view of the section of the truck in FIG. 4. Lift adjustment may be enabled by a pneumatic actuation system, as shown in FIG. 5, the system including one or more pneumatic cylinders that controls lift provided by the DWM system. Coupling of the pneumatic cylinders to a chain crank of the linkage arrangement to actuate rotation of the chain crank and thereby adjust tension in the chain is shown in FIG. 6. An example of a method for adjusting the lift mechanism to achieve DWM in a locomotive is depicted in FIG. 7 and continued in FIG. 8. In FIG. 8, an example of a method is shown for reducing slack on the chain by maintaining an amount of pressure in the pneumatic actuation system.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
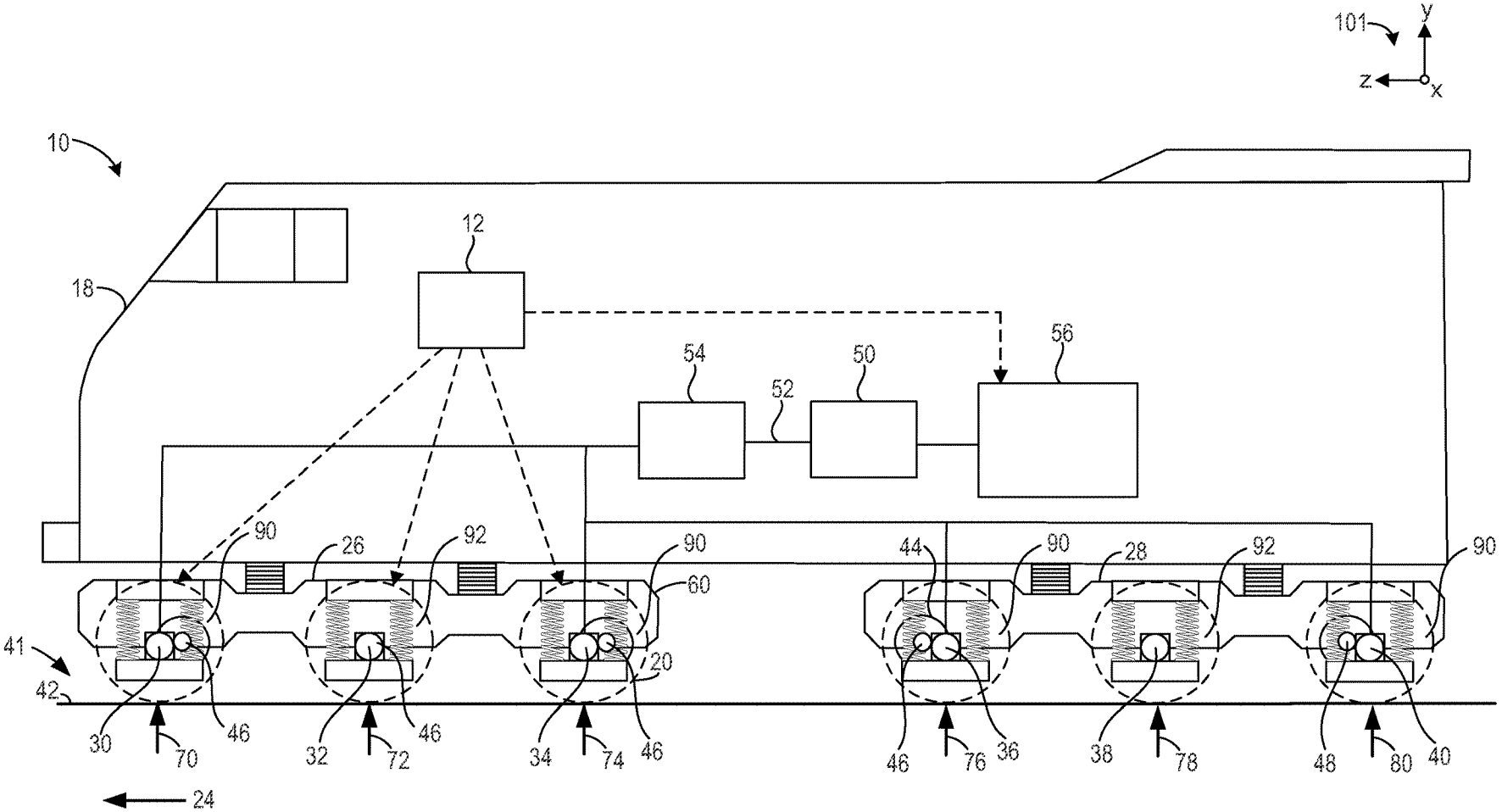
FIG. 1 shows a vehicle comprising a lift mechanism enabling dynamic weight management (DWM).

Referring to FIG. 1, a system 10 including a rail vehicle, such as locomotive 18, is illustrated. However, in alternate examples, the embodiment of system 10 may be utilized with other vehicles, including wheeled vehicles, other rail vehicles, and track vehicles. A set of reference axes 101 are provided, indicating a y-axis, an x-axis, and a z-axis. In some examples, the y-axis may be parallel with a vertical direction, the x-axis parallel with a horizontal direction, and the z-axis with a transverse direction, perpendicular to the y-axis and the x-axis. With reference to FIG. 1, the system 10 is provided for selectively and/or dynamically affecting a normal force 70, 72, 74, 76, 78, 80 applied through one or more of a plurality of axles 30, 32, 34, 36, 38, 40. The rail vehicle 18 illustrated in FIG. 1 can travel along a track 41, and includes a plurality of wheels 20 that are each received by a respective axle 30, 32, 34, 36, 38, 40 of the plurality of axles. Because the vehicle in this example is a locomotive, the route over which it travels is a track 41 and includes a pair of rails 42. The plurality of wheels 20 received by each axle 30, 32, 34, 36, 38, 40 move along a respective rail 42 of track 41 along a travel direction 24.

As illustrated in the example embodiment of FIG. 1, the rail vehicle 18 includes a pair of rotatable trucks 26, 28 which are configured to receive the respective plurality of axles 30, 32, 34, and 36, 38, 40. Trucks 26, 28 may include truck frame element 60 configured to provide compliant engagement with carriers (not shown), via a suspension (not shown). The carriers and suspension may be components of a lift mechanism that relies on a linkage arrangement to allow the lift mechanism to operate at a non-powered axle (for example, axles 32 and 38) of the rail vehicle 18. Details of the lift mechanism are described further below, with respect to FIGS. 2-4. The trucks 26, 28 are configured to be rotated, where one or both of the trucks 26, 28 may be rotated from a forward direction, e.g., along the travel direction 24, to a rear direction, e.g., opposite of travel direction 24.

Each truck 26, 28 may include a pair of spaced apart powered axles 30, 34, 36, 40 and a non-powered axle 32, 38 positioned between the pair of spaced apart powered axles. In other words, truck 26 includes powered axles 30 and 34 with non-powered axle 32 arranged there-between, while truck 28 includes powered axles 36 and 40 with non-powered axle 38 arranged there-between. The powered axles 30, 34, 36, 40 are each respectively coupled to a traction motor 44 and a gear 46. Although FIG. 1 illustrates a pair of spaced apart powered axles and a non-powered axle positioned there-between within each truck, the trucks 26, 28 may include any number of powered axles and at least one non-powered axle, within any positional arrangement.

Each of the powered axles 30, 34, 36, and 40 include a suspension 90, and each of the non-powered axles 32 and 38 include a suspension 92. The suspensions may include various elastic and/or damping members, such as compression springs, leaf springs, coil springs, etc. In the depicted example, the non-powered axles 32, 38 may include a DWM actuator (not shown) configured to dynamically adjust a compression of the non-powered axle suspensions by exerting an internal compression force. The DWM actuator may be, for example, a pneumatic actuator, a hydraulic actuator, an electromechanical actuator, and/or combinations thereof. A vehicle controller 12 may be configured to activate the DWM actuators in response to an engage command, thereby activating the suspensions of the DWC mechanism and performing dynamic weight management (DWM). By adjusting the compression of the non-powered axle suspensions, weight may be dynamically shifted from the non-powered axle 32 to the powered axles 30, 34 of truck 26. In the same way, dynamic weight shifting can also be carried out in truck 28. As such, it is possible to cause a decrease in a downward force on the non-powered axles 32, 38 and increase the tractive effort of the rail vehicle 18 via a corresponding increase in a downward force on the powered axles 30, 34, 36, 40. For example, the weight imparted by the powered axles 30, 34 and 36, 40 on the track may be increased, while the weight imparted by the non-powered axles 32, 38 on the track is correspondingly decreased. In an alternative way, an actuator can exert force on non-powered axles to impact dynamic axle weight. A force to separate the powered axles from the truck frame would increase the axle weight.

Returning to FIG. 1, as depicted, in one example, the rail vehicle is a diesel-electric locomotive operating with a diesel engine 56. However, in alternate embodiments, alternate engines and motive power devices may be employed. Other suitable engines may include a gasoline engine, a biodiesel engine, an alcohol engine, or natural gas engine. Other prime movers may include catenary, fuel cells or battery-operated systems. The vehicle may be fully electric (as with the catenary and/or battery-operated). A traction motor 44, mounted on each truck 26, 28, may receive electrical power from alternator 50 via DC bus 52 to provide tractive power to propel the rail vehicle 18. As described herein, traction motor 44 may be an AC motor. Accordingly, an inverter 54 paired with the traction motor may convert the DC input to an appropriate AC input, such as a three-phase AC input, for subsequent use by the traction motor. In alternate embodiments, traction motor 44 may be a DC motor directly employing the output of the alternator after rectification and transmission along the DC bus. One example configuration includes one inverter/traction motor pair per wheel axle. As depicted herein, 4 inverter-traction motor pairs are shown for each of the powered axles 30, 34 and 36, 40.

Traction motor 44 may act as a generator providing dynamic braking to brake locomotive 18. In particular, during dynamic braking, the traction motor may provide torque in a direction that is opposite from the rolling direction thereby generating electricity that is dissipated as heat by a grid of resistors (not shown) connected to the electrical bus. In one example, the grid includes stacks of resistive elements connected in series directly to the electrical bus. Suitable brakes may include air brakes. Air brakes (not shown) make use of compressed air and may be used as part of a vehicle braking system.

As noted above, to increase the traction of driven axles of the truck (by effecting a weight shift dynamically from at least one axle of the truck to at least another axle of the truck), one embodiment uses pneumatically actuated relative displacement between the non-powered axle (e.g., 32 and/or 38) and the truck frame element 60. The relative displacement of the non-powered axle causes a change (e.g., compression) of the axle suspension 92, thus causing a shift of weight to the powered axles (and additional compression of the suspension 90) to compensate for the reduced normal force 72 at the non-powered axle. This action generates an increased normal force 70, 74 on the powered axles 30, 34, for example.

A lift mechanism, e.g., an adjustable suspension system affecting weight distribution among axles of a vehicle, may be incorporated in a truck of a vehicle such as a rail vehicle to enable variation in a tractive force of the rail vehicle wheels on a set of rails. In one example, the lift mechanism includes a set of springs and a carrier engaged with the set of springs. A linkage arrangement may be coupled to the lift mechanism, connecting components of the truck to the lift mechanism and allowing the connection to transfer motion. The transfer of motion allows a force applied to the lift mechanism to be increased or decreased, adjusting an amount of lift implemented by the lift mechanism at the non-powered axles. Incorporation of a lift mechanism in a truck is depicted FIG. 2 in a detailed view 200 of the front truck 26 of FIG. 1.

Figure 2:
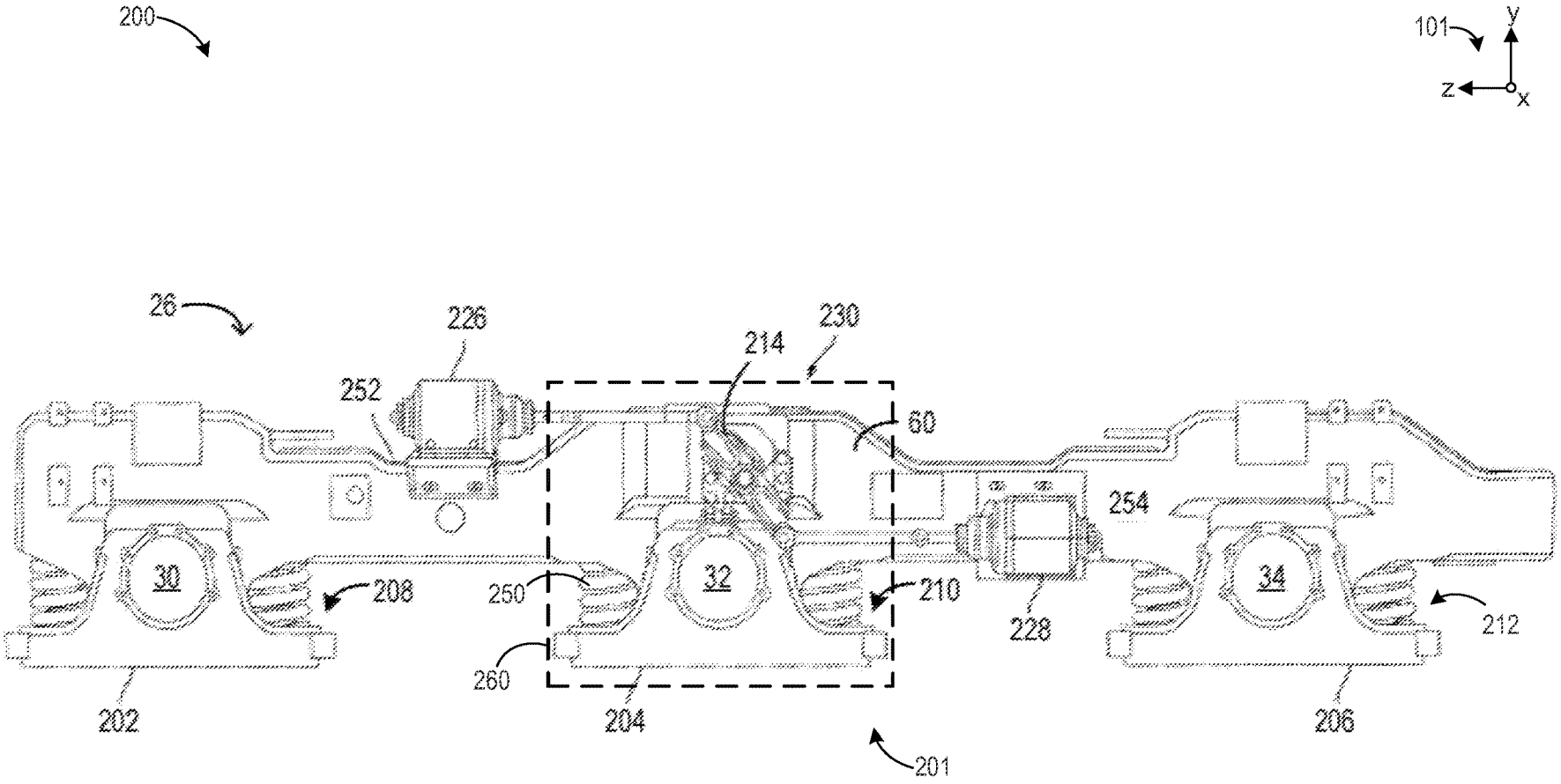
FIG. 2 shows a sectional view of an example truck including the lift mechanism of FIG. 1.

In FIG. 2, the detailed view 200 includes a lift mechanism 201 (herein also referred to as a DWM mechanism) for dynamically redistributing weight between powered and un-powered axles. While the depicted example represents an example truck configuration in the front truck 26, a similar configuration may also be included in the rear truck 28 of FIG. 1. As depicted, truck 26 may include the truck frame element 60 configured for compliant engagement with carriers 202, 204, 206, via the lift mechanism 201. In the embodiment of FIG. 2, spring systems 208, 210, 212 represent the vehicle lift mechanism 201. Each carrier 202, 204, 206 may be configured to hold respective axles 30, 32, 34. Specifically, the carriers may be configured as bearings, or the like, configured to carry the axle. Each spring system 208, 210, 212 provides a structure configured to support respective portions of the truck frame element 60, and portions of the overlying weight of the rail vehicle 18, and thereby bias the truck frame element 60 upward, and away from the carriers 202, 204, 206.

In some examples, portions of the weight supported by each carrier 202, 204, 206, and consequently the upward normal forces 70, 72, 74, on each of the wheels 20 (as shown in FIG. 1) may be selectively, and in some examples, dynamically, redistributed among the carriers 202, 204, 206. In some examples, the weight may be redistributed via a weight transference configured to decrease the weight on the non-powered axle 32, thereby increasing the weight on the powered axles 30, 34 and consequently the tractive effort of the rail vehicle 18 of FIG. 1 via a corresponding increase in the normal forces 70, 74 on the powered wheels. Truck 28 of FIG. 1 may also be similarly constructed such that the weight on the non-powered axle 38 may be decreased, increasing the weight on the powered axles 36, 40 and consequently the tractive effort of rail vehicle 18.

Various actuating arrangements may be employed to reduce the weight on the non-powered axle 32. For example, a pair of actuators 226, 228 in FIG. 2 may be coupled with the truck frame element 60. A first actuator 226 may be coupled to, or near, a top surface 252 of the truck frame element 60, and a second actuator 228 may be coupled to, or near, a lower surface 254 of the truck frame element 60. The actuators may be configured to share the actuating load for actuating a linkage arrangement 230. Specifically, the actuators may each generate forces in opposite directions, yet offset from one another, to generate a coupling torque that rotates a cam or lever arm 214 to generate lifting force on carrier 204 to displace it relative to, and toward, truck frame element 60. Mechanical advantage may be used by the linkage arrangement 230 to amplify the force from the actuators, and in some examples the mechanical advantage may vary depending on the position of the linkage arrangement 230. In one example, the actuators 226, 228 may be pneumatic actuators (as elaborated in FIG. 5). In alternate examples, additionally or optionally, hydraulic, magnetic, and/or various direct or indirect actuators may be used, including but not limited to using one or more servo motors, and the like. Various configurations and numbers of actuators may be employed. In alternate embodiments, the actuators could be coupled to both powered and non-powered axles.

The actuatable linkage arrangement 230 includes a compliant linkage coupled to the carrier 204 to translate rotation of the lever arm 214, as compelled by a pneumatic actuator-generated couple, into vertical motion of the carrier 204 relative to the truck frame element 60. Lever arm 214 may be coupled with a crank (not shown) and may be configured to effect the pivoting of the crank. The two actuators 226, 228 may be configured to exert forces from respectively opposite directions to exert the couple, e.g., the moment of the couple, on the lever arm 214. In one example, the compliant linkage may include a chain, as shown in FIGS. 3 and 4. In alternate examples, the linkage may include a cable, a strap, a rope, slotted rigid members, or the like. The chain may be able to operate in tension (hereafter referred to as a truck chain tension) to support a load at least an order of magnitude, and often two or more orders of magnitude, greater than that in compression.

Tension on the chain may be imposed by forces acting on the chain to compel extension of the chain. For example, tension may be placed on the chain by attaching a first end of the chain to a first object and a second end of the chain to a second object and exerting a force on at least one of the objects in a direction away from the other object. An amount of tension on the chain may be zero or a value greater than zero.

As another example, tension on the chain may be defined by rotation of lever arm 214. A number of degrees through which the lever arm 214 may be rotated may correspond to an initial tightening and lengthening of the chain so that the chain becomes linear, compared to when the chain is slack and not linear, when the lever arm 214 is rotated and the first end of the chain is attached to the lever arm 214 and the second end is anchored to another object. In other words, when the chain is relaxed and slack, a length of the chain may be less than when tension on the chain increased to at least a threshold amount, pulling the chain taut. The length of the chain extending between the lever arm 214 and the object may reach a maximum as the lever arm 214 continues to rotate. Further rotation of the lever arm 214 rotated along a direction that provides lift by the lift mechanism 201 may eventually reach a maximum amount of tension exerted on the chain. The position of the lever arm 214 may have a defined relationship with tension experienced by the chain. By enabling the compliant linkage, e.g., the chain, to pull the carrier against the bias in a first direction, it is possible to selectively control increased compression of the spring system 210 to shift carrier 204 toward the truck frame element 60 and effect a dynamic re-distribution of the load to other axles of the truck assembly.

Alternatively, when the compliant linkage is relaxed, allowing the carrier 204 to shift away from the truck frame element 60 and with the bias in a second direction, opposite the first direction, at least a portion of the load may be transmitted to the non-powered axle 32. When relaxed the compliant linkage may be of a length that provides slack in the compliant linkage to accommodate changes in distance, along the y-axis, between a DWM shaft, as shown in FIGS. 3-4, to which the compliant linkage is coupled and the carrier 204 during vehicle motion. When relaxed, the compliant linkage may be nonlinear. The DWM shaft may bounce up and down, for example, through a 2.5 inch margin, and compliance in the length of the compliant linkage may allow the vertical oscillation of the DWM shaft to occur without altering the loads on the non-powered and powered axles.

Spring system 210 may include one or more springs 250 configured to couple the axle to the truck frame element 60. While FIG. 2 shows two springs biasing each carrier away from the truck frame element 60, more or less springs may be used. A top end of each spring may be attached to the truck frame element 60, and a bottom end of each spring to carrier 204. In one example, as illustrated in FIG. 2, the spring system 208 for powered axle 30 may be substantially similar to the spring system of each powered axle 34, 36, and 40, such as when the rail vehicle can operate in both forward and reverse directions. However, in an alternative example, a front truck may require a greater lift force to compress the carrier 204 than on a rear truck due to the natural weight transfer within the truck or the rail vehicle. As such, the spring system 208 may be used only for axles 30 and 34, but not on axles 36 and 40.

In one example embodiment, spring system 208 may be configured to provide a nonlinear spring rate in response to a deflection between powered axles 30 and 34 and truck frame element 60. In alternate embodiments, spring system 208 may be linear and may provide a spring rate substantially similar to that of spring system 210.

A central section 302 of a truck configuration, which may represent a region of the truck 26 of FIG. 2 as indicated by a dashed rectangle 260, is depicted in a perspective view 300 in FIG. 3 and in an exploded view 400 in FIG. 4. A suspension system of a lift mechanism, e.g., the spring systems 208, 210, and 212 of FIG. 2, are omitted from FIGS. 3 and 4 for simplicity. Common components are similarly numbered in FIGS. 3 and 4. The central section 302 of the truck configuration includes a truck frame 304, a carrier 306 of the lift mechanism, which may be similar to the carrier 204 of FIG. 2, and a linkage arrangement 308. The truck frame 304 is positioned above the carrier 306, with respect to the y-axis, and spaced away from the carrier 306, e.g., surfaces of the truck frame 304 are not in contact with surfaces of the carrier 306.

The carrier 306 has a base 310 with a width 312, defined along the z-axis, greater than a width of an upper portion 314 of the carrier 306. The width 312 of the base 310 may be configured to accommodate an arrangement of springs, e.g., the spring systems 208, 210, and 212 of FIG. 2, at opposite sides of the upper portion 314 within the base 310. The upper portion 314 has a central aperture 316, extending entirely through a thickness 318 of the upper portion, defined along the x-axis, through which an axle, such as the axle 32 of FIG. 2, may be inserted.

The carrier 306 may be coupled to the truck frame 304 by the linkage arrangement 308. The linkage arrangement 308 includes a crank assembly 320 and a chain 340. The chain 340 may extend between a chain crank 322 of the crank assembly 320 and a top surface 324 of the carrier 306. In one example, the chain crank 322 may be the lever arm 214 of FIG. 2. More specifically, a first link 342 of the chain 340 may surround a first end 326 of the chain crank 322 and a fourth link 344 of the chain 340 may surround an anchoring pin 346, the first link 342 and the fourth link 344 representing terminal ends of the chain 340. The anchoring pin 346 may be secured to the top surface 324 of the carrier 306 by threading the anchoring pin 346 through a pair of brackets 348. The pair of brackets 348 may be integrated into a material of the top surface 324, e.g., by casting as a continuous unit, and a distance 350 that the chain extends between the first end 326 of the chain crank 322 and the top surface 324 of the carrier 306 may depend on adjustment of the lift mechanism, as described further below.

It will be appreciated that while the chain 340 is shown in FIGS. 3 and 4 with four links, other examples may vary in a number of links included in the chain or vary in respective dimensions of the links. For example, a chain may similarly have four links but the links may be shorter or longer along the y-axis than the chain 340 of FIGS. 3 and 4 and thereby extend a smaller or larger distance between the chain crank 322 and the carrier 306. As another example, a chain may have two links, three links, or five links instead of four. Various alternatives to the chain 340 shown in FIGS. 3 and 4 have been envisioned without departing from the scope of the present disclosure.

The crank assembly 320 may incorporate several components that, together, allow the chain crank 322 to be pivoted about a DWM shaft of the crank assembly, such as a DWM shaft 402 shown in FIG. 4. The carrier 306 of FIG. 3 is omitted from the exploded view 400 of FIG. 4 for simplicity. In FIG. 4, the DWM shaft 402 extends through an aperture of the chain crank 322 and into an aperture 404 of the truck frame 304 at a first end 401 of the DWM shaft 402. The first end 401 of the DWM shaft 402 may be secured within the aperture 404 by a truck frame bushing 406 that allows rotation of the DWM shaft 402 relative to the truck frame 304.

A second end 403 of the DWM shaft 402 may be inserted into a chain crank bearing 408. The chain crank bearing 408 may be secured to the second end 403 of the DWM shaft 402 by a shaft retaining pin 410. The chain crank bearing 408 may couple the DWM shaft 402 to a DWM cover plate 412 which is, in turn, coupled to a T-bar 414 by a T-bar bushing 416. The components of the crank assembly 320 may be configured to transmit rotation of the T-bar 414 to rotation of the chain crank 322. When the chain crank 322 is compelled to rotate, the chain crank 322 may pivot about the DWM shaft 402. As the chain crank 322 pivots, the first end 326 of the chain crank 322 may shift up and down along the y-axis through an arc as indicated by arrow 418.

Movement of the first end 326 of the chain crank 322 may be translated to vertical movement of the chain 340. The chain 340 may be connected to the first end 326 of the chain crank 322 by a chain crank pin 420 and secured with chain crank bushings 422. The chain crank pin 420 may be inserted through apertures 424 in the first end 326 and through the first link 342 of the chain 340, the first link 342 sandwiched between the apertures 424 in the first end 326 of the chain crank 322. As such, the chain crank pin 420 locks the chain 340 to the chain crank 322.

As the linkage arrangement 308 is pivoted around the DWM shaft 402 in a first direction, e.g., clockwise when viewing the central section 302 of the truck configuration along the x-axis from the second end 403 of the DWM shaft 402 towards the first end 401, the first end 326 of the chain crank 322 may be tilted upwards, along the y-axis. The distance 350, as shown in FIG. 3, the chain 340 extends between the first end 326 of the chain crank 322 and the top surface 324 of the carrier 306 may be increased, eventually stretching the chain 340 taut and pulling the carrier 306 towards the truck frame 304.

When the linkage arrangement 308 is pivoted in a second direction, opposite of the first direction, the first end 326 of the chain crank 322 may be tilted downwards, along the y-axis. The distance 350 the chain 340 extends between the first end 326 of the chain crank 322 and the top surface 324 of the carrier 306 may decrease, reducing a space between the first link 342 and the fourth link 344 and relaxing the chain 340 and, in some examples, allowing slack in the chain 340.

The chain crank 322 may be rotated with the DWM shaft 402 acting as a fulcrum to adjust an amount of lift provided to the lift mechanism. Tilting the first end 326 of the chain crank 322 in the first direction, as described above, increases tension when tilting of the chain crank 322 passes a threshold amount of rotation on the chain 340 and drives upward motion of the chain 340, along the y-axis. The threshold amount of rotation may be, for example, 5 degrees or 10 degrees of rotation or some angle that tightens the chain 340, pulling the chain 340 taut with a minimum amount of imposed tension, before increasing tension on the chain 340 by continuing to rotate the chain crank 322. As the chain 340 is pulled up, the motion of the chain 340 also pulls the carrier 306 upwards and towards the truck frame 304, e.g., lifting the carrier 306, due to securing of the fourth link 344 to the anchoring pin 346 at the top surface 324 of the carrier 306. Lifting the carrier 306 compresses the spring system coupled to the carrier, e.g., the spring system 210 of FIG. 2, and redistributes a load on the carrier 306 to powered axles such as the axles 30 and 34 of FIG. 1 and increasing a tractive force of the powered axles.

Alternatively, the first end 326 of the chain crank 322 may be tilted in the second direction, relieving tension on the chain 340 by lowering the chain 340 and thereby lowering the carrier 306. As the carrier 306 is shifted downwards and away from the truck frame 304, the spring system is decompressed and the carrier 306 imposes a portion of the load onto the non-powered axle from the powered axles. As the carrier 306 shifts the load onto the non-powered axle, the chain 340 is relaxed.

Relaxing the chain 340 to an extent where slack is introduced to the chain 340 may enable a central region, e.g., links between the first link 342 and the fourth link 344, of the chain 340 to swing and move randomly in response to vehicle motion. As the central region of the chain 340 swings, the chain 340 may come into contact with the truck frame 304 and/or the top surface 324 of the carrier 306. High impact collisions between the chain 340 and the truck frame 304 and/or the carrier 306 may result in abrasion and deformation of the truck frame 304 and/or the carrier 306.

Furthermore, rapid conversion between tension on the chain 340 and slack in the chain 340 may result in sudden and forceful contact between the fourth link 344 of the chain 340 and the anchoring pin 346, as shown in FIG. 3, and between the first link 342 of the chain 340 and the chain crank pin 420. As well, the chain links of the chain 340 may rub and compress against one another, causing wear and tear on the links that may lead to degradation of the links, thereby motivating replacement of the chain 340.

To reduce degradation to components of a linkage arrangement caused by changes in tension to chains linking axle carriers to a truck frame, adjustments to actuators of the linkage arrangement may be leveraged to decrease slack in the chains, even when an end of a chain crank coupled to each chain is tilted downwards, releasing tension on the chains. The adjustments may be included in a minimum lift operation utilizing a minimum amount of pressure in a DWM actuation system to decrease random motion of the chains that leads to degradation of adjacent DWM components. Turning now to FIG. 5, a schematic diagram 500 of an example of a pneumatic actuation system 502 that may be coupled to a lift mechanism via a linkage arrangement of a DWM system is shown. The pneumatic actuation system 502 includes a cylinder 510, which may be a non-limiting example of the actuator 226 or 228 of FIG. 2, coupled to a linkage arrangement 501, which may be the linkage arrangement 230 of FIG. 2 or 308 of FIGS. 3 and 4. The pneumatic actuation system 502 also includes a bleed or dump valve 518, a pressure regulator valve 506, and a pressure reservoir 516, arranged serially in line with the dump valve 518 proximate to and fluidly communicating with the cylinder 510 with the pressure regulator valve 506 positioned between the pressure reservoir 516 and the dump valve 518. A pressure in the pressure reservoir 516 may be maintained above ambient pressure by coupling the pressure reservoir 516 to a compressor or an exhaust system of the vehicle.

The pneumatic actuation system 502 is configured to actuate the linkage arrangement 501, and thereby a lift mechanism 503 coupled to the linkage arrangement 501 by adjusting a position of a piston 512 in the cylinder 510. The lift mechanism 503 includes a spring system 526 and a carrier 530. The position of the piston 512 may be adjusted by varying pressure in the cylinder 510 which controls an amount of lift, e.g., compression of the spring system 526, provided by the lift mechanism 503. The pressure in the cylinder 510 is regulated by activation of a combination of the pressure regulator valve 506 and the dump valve 518.

Based on a pressure command ("PSI command") issued from a controller 504, which may, in one example, be the controller 12 of FIG. 1, the pressure regulator valve 506 may be configured to provide air pressure along pneumatic line 508 to the cylinder 510. For example, the controller 504 may compute the pressure command based on a determined lift command. In one example, pressure regulator valve 506 may be a variable orifice pressure valve. Pressurized air may be supplied from pressure reservoir 516 to the pressure regulator valve 506. In one example, when a reduction in lift, or a DWM de-lift, is commanded by the controller 504 (for example, in response to the absence of lift conditions), the pressure in the pneumatic line 508 may be gradually ramped down by the pressure regulator valve 506 by slowly dissipating pressurized air to the atmosphere (atm). When reducing the lift, the controller 504 may further specify a ramp-down rate. The ramp-down rate may be based on, for example, a level of lifting, a vehicle speed, and/or a vehicle tractive effort. In another example, when the pressure commanded is lower than the pressure supplied from the pressure reservoir 516, the difference in pressure may be dissipated to the atmosphere (atm) by the pressure regulator valve 506. In another example, there may be two valves which are independently controlled, one to increase the pressure and another to decrease the pressure, and the actual pressure regulation itself may be achieved by the controller 504 using the pressure feedback. In one example, when the maximum pressure applied is limited, the line pressure may be estimated from the tractive effort obtained as well.

The pressure regulator may be coupled to the cylinder 510 along pneumatic line 508 via the dump valve 518. In one example, the dump valve 518 may be an electromagnetic dump valve alternating between an open position 520 and a closed position 522. Specifically, dump valve 518 may remain in a default closed position 522 until enabled or activated by the passage of an electric current, at which time dump valve may shift to the open position 520. In response to a detected "dump" command, the controller 504 may activate the dump valve to open and the pressure in pneumatic line 508 may be "dumped" to the atmosphere, rapidly and almost instantaneously bringing the air pressure in the line down, for example, down to a range of 0-5 psi (0-34 kPa). In this way, a quick deactivation of the lift mechanism may be provided, for example, in response to a sudden application of friction brakes during an emergency air brake event. Thus, a more rapid lift reduction may be achieved to thereby reduce sliding of the axle.

When rapid lift reduction is requested and a minimum amount of lift for a minimum lift operation is also desired to maintain a chain of the linkage arrangement sufficiently taut to reduce swinging of the chain, the dump valve 518 may be first adjusted to the open position 520 to dissipate pressure to or near ambient pressure. The dump valve 518 may then be shifted to the closed position 522 and the pressure regulator valve 506 opened to allow the pressure in the cylinder to reach a target pressure, such as 7-10 psi (48-69 kPa).

A controlled deactivation of the DWM mechanism may be used during a de-lift operation (e.g., during an operation wherein the rail vehicle is changed from operating with lift to operating with no lift, or less lift). It will be appreciated that while the figure depicts a single cylinder coupled to a single spring of the spring system by way of the linkage arrangement 501, a similar command may be given in parallel to another cylinder linked to a second spring of the spring system.

During a DWM lift operation, dump valve 518 may remain closed and pressure regulator valve 506 may generate a pressure in the pneumatic line 508 based on the commanded pressure. A pressure sensor 524 may monitor the pressure (P) in the line. The commanded pressure may be transferred to side cylinder 510. The movement of side cylinder 510 may then be relayed to and transformed into a corresponding lift in spring system 526, which, in one example, may be the spring system 210 of FIG. 2. In one example, when an increase in lift is indicated, movement of side cylinder 510 may enable springs 528 of spring system 526 to decrease their compression rate, thereby bringing carrier 530 closer to truck frame 532, which may be, for example, the carrier 306 and truck frame 304 of FIG. 3. In another example, when a decrease in lift is commanded (or when a DWM de-lift is commanded), the movement of side cylinder 510 may enable springs 528 of spring system 526 to increase their compression rate, thereby pushing carrier 530 further from truck frame 532. The controller 504, when performing DWM control, is responsible for the air pressure on the DWM pneumatic cylinders, which in turn shift weight from non-powered to powered axles on the rail vehicle. In one example, a push mechanism is used to perform the DWM lift under some conditions and an alternate mechanism (such as a pull mechanism) is used to perform a DWM de-lift under different conditions.

At least one cylinder, e.g., the cylinder 510 of FIG. 5, may be coupled to a chain crank, e.g., the chain crank 322 of FIGS. 3 and 4, of a linkage arrangement. In some examples, as shown in an example embodiment of a section of a truck configuration 600 in FIG. 6, a first cylinder 602, which may be a non-limiting example of the cylinder 510 of FIG. 5, may be aligned with the z-axis and attached or tethered to a first end 604 of a T-bar 606 of a crank assembly 608 by a first piston rod 603 extending between a first piston 650 of the first cylinder 602 and the first end 604 of the T-bar 606. A second cylinder 610, which may also be used similarly as the cylinder 510 of FIG. 5, may also be aligned along the z-axis and tethered to a second end 612 of the T-bar 606, the second end 612 opposite of the first end 604, by a second piston rod 605 extending between a second piston 660 of the second cylinder 610 and the second end 612 of the T-bar 606. The first cylinder 602 and the second cylinder 610 may be positioned on opposite sides of the T-bar 606, along the z-axis. Motion of the first piston rod 603 and the second piston rod 605 along the z-axis in and out of the first and second cylinders 602 and 610, respectively, is indicated by arrows 630.

As an example, the crank assembly 608 may be configured opposite of the crank assembly 320 of FIGS. 3 and 4. In such a configuration, a chain crank may pivot about a DWM shaft as a fulcrum and include a lever arm that extends to the right of the DWM shaft, instead of the left as down in FIGS. 3 and 4. A linkage chain may be coupled to an end of the lever arm distal to the DWM shaft. To rotate the T-bar 606 clockwise and decrease lift (e.g., adjust a lift mechanism 618 to a de-lifted configuration) at a non-powered axle 614 coupled to a carrier 616, a pressure at the first cylinder 602 may be decreased, pulling the first piston rod 601 and the first piston 650 to the right and into the first cylinder 602. Concurrently, a pressure at the second cylinder 610 may also be decreased, pulling the second piston rod 603 and the second piston 660 to the left and into the second cylinder 610. Retraction of the both the first and second piston rods 601, 603 into their respective cylinders drives clockwise pivoting of the T-bar 606 and the chain crank, the chain crank coupled to the T-bar 606 by components of the crank assembly 608.

To rotate the T-bar 606 counterclockwise and increase lift at the non-powered axle 614 coupled to a carrier 616, a pressure at the first cylinder 602 may be increased, pushing the first piston rod 601 and the first piston 650 to the left and out of the first cylinder 602. Concurrently, a pressure at the second cylinder 610 may also be increased, pushing the second piston rod 603 and the second piston 660 to the right and out of the second cylinder 610. Extension of the both the first and second piston rods 601, 603 out of their respective cylinders drives counterclockwise pivoting of the T-bar 606 and chain crank.

The first and second cylinders 602 and 610 may be configured to hold a maximum pressure that results in a maximum extension of the first piston rod 601 and the second piston rod 603 out of their respective cylinders. The maximum extension may correspond to fully extended piston positions where the first piston 650 shifts to the left to a maximum extent and the second piston 660 shifts to the right to a maximum extent within their respective cylinders. During de-lift that leads to slack in a chain linking the carrier 616 to a truck frame 620 (such as the chain 340 of FIGS. 3 and 4), the first piston 650 may shift to the right to a maximum extent within the first cylinder 602 and the second piston 660 may shift to the left to a maximum extent within the second cylinder 610, corresponding to fully retracted piston positions.

As described above, when the lift at the carrier 616 is reduced, and in particular, when the carrier is de-lifted to a maximum extent, slack in the chain may result in forceful, compressive contact between the chain and components of the linkage arrangement, including the crank assembly 608, the carrier 616, the truck frame 620 and the chain. By holding the first and second cylinders 602, 610 at a low pressure during de-lifted configurations, an amount of tension may be maintained on the chain. The amount of tension may maintain the first piston 650 of the first cylinder 602 and the second piston 660 of the second cylinder 610 at a position between the fully extended (e.g., elevated pressure in the cylinders) and the fully retracted (e.g., ambient pressure in the cylinders) positions. For example, when adjustment of the carrier 616 to a de-lifted configuration from a lifted configuration is commanded during a braking event, the pressure in the cylinders may be decreased to a pressure level above 0 psi but lower than pressures in the cylinders during lifting operations. For example, the pressure may be adjusted to 7 psi (48 kPa) or 12 psi (83 kPa). In another example, the pressure may be a pressure level between 7-10 psi (48-69 kPa). The pressure in the cylinders may be a suitable level of pressure that reduces chain slack so that the chain does not move freely or randomly but does not adversely affect load re-distribution via the linkage arrangement and lifting mechanism. Thus the pressure used to reduce chain slack during de-lifting events may vary depending on various factors such as a total rail vehicle load, dimensions of the lift mechanism, a length of the chain, etc.

The cylinders may be configured to operate under high pressure loading. As such, gaskets utilized in the cylinders may be adapted to hold pressures much higher than, for example, 7-10 psi (48-69 kPa) but may be prone to leakage at lower pressures. To compensate for loss of pressure when the DWM mechanism is in the de-lifted configuration, the cylinders may be periodically recharged. For example, a pressure regulator valve, such as the pressure regulator valve 506 of FIG. 5, controlling delivery of high pressure from a pressure reservoir to the cylinders, may be commanded to deliver between 7-10 psi (48-69 kPa) to the cylinders every 20 minutes during de-lift events.

By periodically regulating and recharging the cylinders, constant and continuous activation and operation of an actuation system, such as the pneumatic actuation system 502 of FIG. 5, is precluded. Constant regulation of pressure at the cylinders may greatly decrease a duty cycle of the actuation system, resulting in increased costs due to more frequent maintenance and replacement of actuation system components. For example, periodic recharging (rather than continuous) may decrease duty cycles of magnetic pneumatic valves of the cylinders and also decrease air usage at the actuation system. Thus intermittent use of the actuation system, at a frequency that offsets leakage in the cylinders, may at least partially compensate for activation of the actuation system during de-lift operations. As the rail vehicle may be disposed in the lifted configuration for longer and more frequent periods of time than the de-lifted configuration, e.g., during 97% of operating time, rail vehicle truck assemblies are in the lifted configuration and in the de-lifted configuration for 3% of operating time, periodic regulation of the cylinder pressure during the de-lift events may have a low overall impact on wear of the actuation system components.

Pressure at the cylinders may be adjusted according to an operating mode of the rail vehicle as detected by various sensors and actuators in the rail vehicle. For example, when the rail vehicle is in motion but no DWM lift is requested, an actuator pressure sensor may allow detection of a status of the linkage chain, e.g., whether the chain is slack or taut, based on a signature of the pressure sensor. The pneumatic actuation system may be activated to either increase or decrease the cylinder pressure based on the pressure signature and an offset of the pressure signature from a target actuator pressure. In addition, in some examples, the target actuator pressure may be variable to maintain ride quality and/or to maintain a minimum axle weight demand when the rail vehicle navigates uneven track regions that result in undulations. For example, the target pressure may be decreased as rail vehicle speed increases to offset bumpy track conditions that are exacerbated by high travelling speed and provide a smoother ride. The target actuator pressure to which the cylinders are recharged may fall within a finite range of pressures to accommodate an influence of a DWM mechanism on the cylinder pressures.

In one example, the target actuator pressure for maintaining the chain taut may be 15 psi (103 kPa). However, during rail vehicle motion, the actuator pressure may deviate from the target pressure or the target pressure may be modified based on anticipated or unexpected changes in vehicle speed, and may therefore vary between a minimum pressure of 8 psi (55 kPa) and a maximum pressure of 20 psi (138 kPa). Detection of actuator pressure decreasing to 8 psi when the DWM mechanism is not actively transferring weight to the powered axles may result in recharging of the actuator pressure. Detection of actuator pressure approaching 20 psi may initiate opening of a bleed valve, such as the dump valve 518 of FIG. 5, to reduce the actuator pressure.

Mitigating actions may be performed by the DWM mechanism for maintenance and assessment of DWM components. For example, when the cylinders are static for a threshold period of time when maintaining the linkage chain in a taut configuration, such as 15, or 20 minutes, regardless of whether recharging events have occurred, cylinder motion (e.g., sliding of cylinder pistons) may be initiated by adjusting pressure. Motion in the cylinder may distribute lubricant within the cylinder and reduce degradation of the cylinder arising from repeated localized wiping and wear associated with maintaining the linkage chain taut.

In another example, the pressure may be released from the cylinders to return to ambient pressure if cylinder pressure is detected to rise above a threshold pressure, such as 20 psi (138 kPa) indicating that either unexpected conditions demanding adjustments to the DWM mechanism are occurring or presence of a problem developing at the actuation system. Furthermore, the actuation system may be configured to release the cylinder pressure when the rail vehicle is not in motion and also when air brakes are applied. Venting pressure in response to air brake application may reduce a likelihood of wheel slide which may occur due to a reduction in axle weight at the non-powered axle when cylinder pressure is elevated above ambient.

As another example, the cylinders may be evaluated for leakage by monitoring the pressure in the cylinders over a period of time, such as 5 or 10 minutes after a recharging event. For example, the pressure signature in the cylinders may be measured and if the pressure decreases by a threshold amount over the predetermined period of time, the cylinder may be deemed leaky. The threshold amount may be a decrease of 5, 10, or 15%, for example. If the cylinder is determined to be leaking, an adaptive control strategy may be executed by a system controller to support the leaky cylinder(s). For example, additional valves providing air flow to the cylinders may be actuated to compensate for lost pressure or valves of the actuation system may be actuated more frequently.

It will appreciated that while the example of the actuation system shown in FIG. 5, and described below with respect to methods 700 and 800 of FIGS. 7 and 8, is a pneumatic system relying on compressed air to facilitate movement of pistons with cylinders of the actuation system, various alternative types of actuation systems may be used in place of the pneumatic system without departing from the scope of the present disclosure. For example, the actuation system may be hydraulic, utilizing hydraulic fluid to effect piston movement in the cylinders. An electric motor may be used instead of pneumatic or hydraulic-based actuation or the actuation system may include a combination of mechanism types.

An example of a method 700 for adjusting lift of a DWM mechanism, such as the lift mechanism 201 of FIG. 2, during operation of a vehicle such as a rail vehicle is shown in FIG. 7. The method is continued in FIG. 8 by a method 800 for detecting leaks in actuators, or cylinders, of the lift mechanism. The rail vehicle may have one or more trucks with at least one powered axle and at least one non-powered axle. The DWM mechanism may include sets of springs arranged between a truck frame and an axle carrier supporting the non-powered axle of the truck. The DWM mechanism is coupled to a linkage arrangement, such as the linkage arrangement 230 of FIG. 2 and 308 of FIGS. 3 and 4, with a crank assembly that pivots about a shaft. Pivoting of the crank assembly, in turn, varies the DWM mechanism between lift and de-lift and thereby increases or decreases a tractive effort of the rail vehicle, respectively, the pivoting enabled by a pneumatic actuation system, e.g., the pneumatic actuation system 502 of FIG. 5. By regulating a pressure communicated to cylinders of the pneumatic actuation system, the crank assembly is rotated, applying tension on chains coupling the carriers to the truck frame during lift and reducing tension on the chains during de-lift. Instructions for carrying out method 700 and 800 and the rest of the methods included herein may be executed by a controller at the start of and during vehicle operation, to dynamically redistribute the rail vehicle load between the powered and non-powered axles.

Turning now to FIG. 7, at 702, the method includes determining if the rail vehicle is in motion, propelled along a track. If the rail vehicle is stationary and not moving, the method continues to 704 to either dump pressure in the cylinders if the cylinders are under pressure, or maintain the cylinders in a depressurized state. The method then returns to the start. If the rail vehicle is determined to be in motion by, in one example, the controller receiving information from sensors monitoring rotation of the rail vehicle wheels, the method proceeds to 706. In other examples, determination of rail vehicle motion may be achieved by a variety of methods via various sensors in the rail vehicle.

At 706, the method includes determining if a DWM lift operation or pressure dump is requested. DWM lift may be demanded when the rail vehicle accelerates and increased tractive effort is desired from the powered axles. In response to the request for DWM lift, pressure in the cylinders may be increased. In contrast, a pressure dump is requested when rapid deceleration of the rail vehicle is requested by, for example, applying air brakes. Dumping of cylinder pressure may reduce a likelihood of wheel slide of the non-powered axle. Additionally or alternatively anticipation of the vehicle becoming stationary may also trigger the pressure dump. Furthermore cylinder pressure may be vented in response to detection of unexpected changes to actuator pressure, such as, for example, pressure accumulation due to degraded components in the pneumatic actuation system and/or DWM mechanism, in response to unexpected dynamic conditions. For example, the rail vehicle may experience high amplitude vibrations or high duty cycles of actuator motion may generate high thermal loads at the DWM mechanism.

If a request for either DWM lift or pressure dump is detected, the method continues to 708 to perform the requested action and the method returns to the start. If either the DWM lift or pressure dump is not requested at 706, the method continues to 710 determine if the cylinder pressure is greater than a first threshold.

At 710, a minimum lift operation of the DWM mechanism may begin. The minimum lift operation is indicated by dashed box 701 and includes subsequent operations and events shown in method 700. It will be appreciated that if, at any point during the minimum lift operation, a request for DWM lift (e.g., increase in cylinder pressure) or pressure dump (e.g., decrease in cylinder pressure) is detected, the request is prioritized over the minimum lift operation and the requested operation is performed.

The first threshold may be an upper boundary of a range of pressure that the cylinder may be pressurized to during rail vehicle operation without active lifting. For example, the upper boundary, representing a chain over-tension check, may be 20 psi (138 kPa). If the cylinder pressure rises above 20 psi, weight may be transferred to the powered axles of the rail vehicle. By monitoring the cylinder pressure against the first threshold, unintentional weight transfer to the powered axles is circumvented during dynamic motion of the rail vehicle. If the cylinder pressure is determined to exceed the first threshold, the method continues to 712 to adjust cylinder pressure by opening a bleed valve (e.g., the dump valve 518 of FIG. 5) to reduce the cylinder pressure to a target pressure.

The target pressure may be a cylinder pressure that maintains the chain taut without transferring weight to the powered axles. The target pressure is lower than the first threshold. In one example, the target pressure may be 15 psi (103 kPa). However, the target pressure may vary depending on vehicle speed, rail conditions etc.

Opening the bleed valve vents pressure in the cylinder, allows the cylinder pressure to decrease. The bleed valve may be opened for a period of time corresponding to a specific decrease in pressure. For example, the controller may consult a look-up table providing a relationship between bleed valve opening duration and amount of pressure reduction. The bleed valve may be opened according to a desired reduction in pressure and then closed. The method returns to 710 to compare the cylinder pressure against the first threshold. If the cylinder pressure does not exceed the first threshold, the method proceeds to 714 to determine if a period of time since the start of method 700 reaches or surpasses a second threshold.

The second threshold may be a charge cycle time threshold, such as 10 or 20 minutes, that mitigates overly frequent recharging of the cylinder and valve cycling. Implementing the charge cycle threshold may reduce wear on valves and other components. Monitoring elapsed time based on the second threshold also decreases instability in the control system of the rail vehicle caused by dynamic pressure variations. The dynamic pressure variations may arise from dynamic responses of the DWM mechanism to interactions between a journal box, housing a journal of the DWM mechanism, and the truck frame during rail vehicle operation. If the elapsed time does not reach or exceed the second threshold, the method proceeds to 722 to determine if the elapsed time exceeds a fourth threshold, described further below. If the elapsed time reaches the second threshold, the method continues to 716 to determine if the cylinder pressure is below a third threshold.

The third threshold may be a lower boundary of the range of pressures the cylinder is pressurized to during rail vehicle operation without active lifting. When cylinder pressure is below the third threshold, the chain may be slack and prone to backlash and random motion, increasing a likelihood of impact with adjacent components. If the cylinder pressure is below the third threshold, the method continues to 718 to adjust the cylinder pressure to the target pressure.

The target pressure may be a pressure, as described above, at which the chain is taut but weight is not shifted to the powered axles of the rail vehicle. The target pressure is higher than the third threshold and lower than the first threshold. The cylinder pressure may be increased to the target pressure by opening a pressure regulator valve of the actuation system, such as the pressure regulator valve 506 of FIG. 5. For example, the controller may consult a look-up table providing a relationship between pressure regulator valve opening duration and amount of pressure rise in the cylinder. The regulator valve may be opened according to a desired increase in pressure and then closed. The method returns to 710 to compare the cylinder pressure to the first threshold.

If the cylinder pressure is not below the third threshold, the method continues to 720 to test the cylinder for leakage, as depicted by method 800 in FIG. 8. After the cylinder is tested, the method continues to 722 to determine if the elapsed time surpasses a fourth threshold.

The fourth threshold may be a lubricant-cycle time threshold that is longer than the second threshold. As an example, the fourth threshold may be a time period of 2 hours. The motion of a piston within the cylinder may be enabled by lubricating the piston, thereby reducing a likelihood that seals of the cylinder seize during operation. The lubricant may be dispersed along the piston and seals by periodically moving the piston back and forth within the cylinder. The fourth threshold may therefore be a period of time passed where moving the piston to spread lubricant becomes important towards effectively reducing the likelihood of seal seizure.

If the elapsed time does not reach or exceed the fourth threshold, the method returns to 710 to compare the cylinder pressure to the first threshold. If the elapsed time at least reaches the fourth threshold, the method continues to 724 to determine if lift or pressure dump is requested of the DWM mechanism, as described above at 706. If lift/pressure dump is requested, the requested operation is performed at 726 and the method returns.

If no lift/pressure dump is requested at 724, the method continues to 728 to perform lubricant cycling at the cylinder. Lubricant cycling may include opening the bleed valve to vent at least a portion of the cylinder pressure, enabling the cylinder piston to slide within the cylinder. The bleed valve is closed and the cylinder is recharged to the target pressure at 730. As described above, the target pressure may be a value between the first and third thresholds that maintains tautness in the chain without implementing lift operation at the DWM mechanism. The method then returns.

Method 800 depicted in FIG. 8 is a method for evaluating conditions during the minimum lift operation as described above for method 700 of FIG. 7. At 802, the method includes determining if the time elapsed since performing the minimum lift operation reaches a first threshold. The fifth threshold may be a pre-determined period of time for assessing if pressure is sealed within the cylinders. For example, the fifth threshold may be 3 minutes, or 5 minutes, 10 minutes, or some other period of time shorter than the recharging interval of the cylinders, e.g., the second threshold of method 700. If the elapsed time does not reach the fifth threshold, the method proceeds to 804 to continue maintaining the pressure within the closed system of the cylinders by, for example, maintaining the pressure regulator valve of the pneumatic actuation system closed as well as a dump valve.

If the elapsed time is at least equal to the fifth threshold, the method continues to 806 to measure the pressure at the cylinders. The pressure may be detected by pressure sensors positioned in the cylinders. At 808, the method includes determining if the pressure has decreased by an amount equal to or greater than a sixth threshold. The sixth threshold may be a reduction in cylinder pressure indicative of leakage through cylinder gaskets. In one example, the sixth threshold may be a 5% decrease. In other examples, the sixth threshold may be 3% or 7% or some other amount that infers accelerated pressure loss within the threshold period of time (e.g., the first threshold of method 800).

If the pressure does not decrease by an amount at least equal to the sixth threshold, the method proceeds to 810 to continue maintaining pressure in the cylinders without activation of the pneumatic actuation system. The method then returns to 722 of method 700 to compare a period of time elapsed against the fourth threshold. If the pressure decreases by an amount at least equal to the sixth threshold, the method continues to 812 to perform mitigating actions to compensate for air leakage in the cylinders. For example, the mitigating actions may include actuating valves of the pneumatic actuation to open and communicate pressure from the pressure reservoir to the cylinders, e.g., to recharge the cylinders, at an increased frequency. Pressure in the cylinders may be supplemented by more frequent recharging, the increased recharging cycles continuing until the rail vehicle stops. The controller may command activation of an alert to notify an operator of the leakage.

In this way, degradation of components of a rail vehicle truck, including a DWM mechanism and a linkage arrangement coupled to the DWM mechanism, caused by a slack linkage chain during de-lift operations may be reduced. When fully relaxed, the chain may abrade adjacent parts and surfaces, such as the truck frame, as well as links of the chain itself due to undesirable leeway allowing motion of the chain. Furthermore, rapid changes in chain tension between slack and taut may erode a structural integrity of the chain, leading to frequent maintenance and replacement. By adjusting a pressure in an actuation system of the DWM mechanism, a low level of tension may be maintained on the chain during de-lift events to impart the chain with an amount of tautness that does not impose a load shift to the powered axles but minimizes motion of the chain. The slight tension on the chain allows the chain to transition between lift and de-lift operations without experiencing drastic changes in tension. An amount of tension on the chain may be implemented by maintaining a low pressure in cylinders of the actuation system, the cylinders coupled to the linkage arrangement and controlling rotation of a chain crank. The pressure in the cylinders may be charged to a low pressure, such as 7-10 psi, during de-lift events, and periodically recharged, such as every 20 minutes, rather than continuously monitored to reduce operation of the pneumatic actuation system. Thus integrity of the truck components is prolonged without adversely affecting a useful life of the pneumatic actuation system.

A technical effect of maintaining a low level of tension on the linkage chain during de-lift operations of the DWM mechanism is that random motion of the chain is restrained and sudden changes in tension on the chain are buffered.

In another representation, a method includes responding to a request to de-lift a lift mechanism by reducing pressure in an actuator coupled to the lift mechanism, the lift mechanism configured to transfer a load from a first axle to a second axle of the vehicle during the de-lift, and during the de-lift, maintaining the pressure in the actuator at or above a threshold pressure to maintain a threshold tension on a weight transfer device of the lift mechanism. In a first example of the method, transferring the load to the second axle reduces tension imposed on the weight transfer device. A second example of the method optionally includes the first example and further includes, varying tension in the weight transfer device when a crank coupled to the weight transfer device is rotated by adjusting the pressure in the actuator. A third example of the method optionally includes one or more of the first and second examples, and further includes, wherein adjusting the pressure in the actuator includes adjusting the pressure to a level that pulls the weight transfer device taut without weight shift on the second axle. A fourth example of the method optionally includes one or more of the first through third examples, and further includes, wherein adjusting the pressure to pull the weight transfer device taut includes adjusting the pressure in the actuator to a target pressure greater than zero and lower than the pressure in the actuator when lift is implemented by the lift mechanism, lift opposite of de-lift. A fifth example of the method optionally includes one or more of the first through fourth examples, and further includes, wherein adjusting the pressure in the actuator includes activating the actuator to pressurize the actuator to the target pressure and deactivating the actuator upon reaching the target pressure in the actuator. A sixth example of the method optionally includes one or more of the first through fifth examples, and further includes, wherein adjusting the pressure in the actuator to the target pressure includes allowing a threshold period of time, wherein the threshold period of time is a value greater than zero, to elapse and then recharging the pressure to the target pressure by activating the actuator.

In yet another representation, a method includes, responsive to a first operating condition, adjusting a lift mechanism configured to dynamically transfer a load between a first axle and a second axle via a linkage arrangement coupled to the lift mechanism to reduce the load at the second axle, and in response to a second operating condition, adjusting the lift mechanism to increase the load at the second axle while maintaining a threshold amount of tension in a linkage chain of the linkage arrangement, the threshold amount greater than an amount of tension when the linkage chain is relaxed. In a first example of the method, adjusting the lift mechanism in response to the first operating condition increases a tractive effort of the vehicle and includes transferring at least a portion of the load from the second axle to the first axle by altering a pressure in an actuation system of the lift mechanism. A second example of the method optionally includes the first example, and further includes, wherein increasing the load at the second axle includes transferring at least a portion of the load from the first axle to the second axle by altering the pressure in the actuation system. A third example of the method optionally includes one or more of the first and second examples, and further includes, wherein increasing the load at the second axle is commanded based on a request for decreased tractive effort of the first axle. A fourth example of the method optionally includes one or more of the first through third examples, and further includes, wherein increasing the load at the second axle is commanded based on an anticipated decrease in vehicle speed due to air braking. A fifth example of the method optionally includes one or more of the first through fourth examples, and further includes, wherein increasing the load at the second axle is commanded based on determination of an increased likelihood of axle sliding and axle slip. A sixth example of the method optionally includes one or more of the first through fifth examples, and further includes, wherein maintaining the threshold tension on the chain includes maintaining a lower pressure in the actuation system than a pressure in the actuation system when the load is transferred to the first axle. A seventh example of the method optionally includes one or more of the first through sixth examples, and further includes, wherein increasing the load at the axle while maintaining the threshold tension on the linkage chain includes maintaining the chain at a greater extension spanning a greater distance between a first end of the chain and a second end of the chain than the distance between the first end and the second end of the chain when the chain is relaxed.

In yet another representation, a vehicle system includes a lift mechanism coupled to a truck by a rotatable linkage, the lift mechanism having a chain extending between the linkage and a carrier of the lift mechanism, and an actuation system configured to adjust the lift mechanism by rotating the linkage and to maintain tension on the chain by maintaining a threshold level of pressure in the actuation system. In a first example of the system, the lift mechanism includes a set of springs arranged between the frame of the truck and the carrier. A second example of the system optionally includes the first examples and further includes, wherein the actuation system is a pneumatic actuation system and includes a pressure reservoir, a pressure regulating valve, a dump valve, and at least one pneumatic cylinder. A third example of the system optionally includes one or more of the first and second examples, and further includes, wherein the linkage includes a rotatable shaft coupled to the chain, and a T-bar coupled to the actuation system and the linkage, wherein the rotatable shaft and the T-bar are configured to rotate as a single unit. A fourth example of the system optionally includes one or more of the first through third examples, and further includes, wherein the threshold level of pressure in the actuation system to maintain tension on the chain is a pressure between 7-10 psi.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for a vehicle comprising:

responding to a request to de-lift a lift mechanism by reducing pressure in an actuator coupled to the lift mechanism, wherein the lift mechanism is configured to transfer a load from a first axle to a second axle of the vehicle during the de-lift;

during the de-lift, maintaining the pressure in the actuator at or above a threshold pressure to maintain tension in a weight transfer device of the lift mechanism; and varying tension in the weight transfer device when a crank coupled to both the weight transfer device and the actuator is rotated by adjusting the pressure in the actuator, wherein adjusting the pressure in the actuator includes adjusting the pressure to a level that pulls the weight transfer device taut without weight shift onto the second axle.

2. The method of claim 1, wherein maintaining pressure in the actuator at or above the threshold pressure reduces at least one of slack, backlash, and/or random motion of the weight transfer device, or reduces contact and impact between the weight transfer device and adjacent components of the lift mechanism, relative to maintaining the pressure below the threshold pressure.

3. The method of claim 1, wherein adjusting the pressure to pull the weight transfer device taut includes adjusting the pressure in the actuator to a target pressure, the target pressure greater than zero and lower than the pressure in the actuator when lift is implemented by the lift mechanism, lift opposite of de-lift.

4. The method of claim 3, wherein adjusting the pressure in the actuator to the threshold pressure includes allowing a threshold period of time to elapse and then recharging the pressure to the target pressure by activating the actuation system and wherein the threshold period of time is a value greater than zero.

5. The method of claim 1, wherein adjusting the pressure includes determining an amount of slack in the weight transfer device based on a pressure signature measured in the actuator.

6. The method of claim 1, wherein maintaining the pressure in the actuator includes deactivating an actuation system delivering pressure to the actuator by closing valves of the actuation system to block air flow between the actuation system and the actuator.

7. The method of claim 1, wherein reducing the pressure in the actuator further comprises, responsive to when a request for a pressure dump is detected, prioritizing the pressure dump over maintaining pressure on the weight transfer device by reducing the pressure to below the threshold pressure.

8. The method of claim 1, further comprising transferring weight from the second axle to the first axle to facilitate lift at the lift mechanism and prioritizing lift over maintaining tension on the weight transfer device when a request for lift is detected.

9. A method for a vehicle comprising:

adjusting a lift mechanism configured to transfer a load between a first axle and a second axle via a linkage arrangement coupled to the lift mechanism to reduce slack in a weight transfer device of the linkage arrangement, wherein the slack in the weight transfer device is reduced without causing weight shift onto the second axle; and detecting an air leak in an actuator of the lift mechanism, the actuator coupled to the linkage arrangement and configured to adjust a position of the linkage arrangement and tension on the weight transfer device.

10. The method of claim 9, wherein adjusting the lift mechanism includes adjusting the pressure of the actuator to a non-zero pressure that maintains the weight transfer device taut.

11. The method of claim 10, wherein adjusting the pressure in the actuator includes charging the actuator to the non-zero pressure by activating an actuation system delivering pressure to the actuator and deactivating the actuation system after recharging.

12. The method of claim 11, wherein detecting the air leak in the actuator includes allowing a threshold period of time to elapse after deactivating the actuation system and measuring the pressure in the actuator after the threshold period of time has elapsed.

13. The method of claim 12, wherein detecting the air leak in the actuator includes comparing a measured pressure in the actuator to the non-zero pressure and adopting additional valve cycling of the actuation system to compensate for loss of pressure in the actuator.

14. A vehicle, comprising:

a lift mechanism having a weight transfer device to transfer a load from a first axle to a second axle of the vehicle during a de-lift event; and an actuation system configured to maintain tension in the weight transfer device by maintaining a threshold level of pressure in the actuation system, wherein the tension is maintained in the weight transfer device without causing weight shift onto the second axle.

15. The vehicle of claim 14, wherein the lift mechanism further comprises a rotatable crank coupled to both the weight transfer device and the actuation system and wherein the rotatable crank is configured to rotate in a first direction to pull the weight transfer device taut when a pressure in the actuation system is elevated during a lift event and rotate in a second, opposite direction to reduce tautness of the weight transfer device when the pressure in the actuation system is decreased, relative to the lift event, during the de-lift event.

16. The vehicle of claim 15, wherein the threshold level of pressure in the actuation system during the de-lift event is an amount of pressure lower than the pressure in the actuation system during the lift event and greater than zero.

17. The vehicle of claim 14, further comprising a controller with computer readable instructions stored on non-transitory memory that when executed during the de-lift event, cause the controller to adjust the pressure to the target pressure and maintain the load on the second axle of the vehicle.

18. The vehicle of claim 14, wherein a piston of the actuation system is adjusted to a position between a fully retracted position and a fully extended position when the pressure in the actuation system is at the threshold level of pressure.

* * * * *